US006693555B1

(12) United States Patent
Colmenarez et al.

(10) Patent No.: US 6,693,555 B1
(45) Date of Patent: Feb. 17, 2004

(54) AUTOMATIC SETTING OF VARIABLE SPEED LIMIT

(75) Inventors: Antonio Colmenarez, Peekskill, NY (US); Vasanth Philomin, Briarcliff Manor, NY (US); Srinivas Gutta, Buchanan, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 108 days.

(21) Appl. No.: 10/014,230

(22) Filed: Dec. 11, 2001

(51) Int. Cl.[7] ..... G08G 1/09

(52) U.S. Cl. ..... 340/905; 340/441; 340/539.13; 340/601; 340/602; 701/118

(58) Field of Search ..... 340/905, 441, 340/539.1, 601, 602, 539.13; 701/118

(56) References Cited

U.S. PATENT DOCUMENTS 5,673,039 A * 9/1997 Pietzsch et al. ..... 340/905
5,729,214 A * 3/1998 Moore ..... 340/905

* cited by examiner

*Primary Examiner*—Julie Lieu
(74) *Attorney, Agent, or Firm*—Aaron Waxler

(57) ABSTRACT

A system and method for automatic setting of a variable speed limits permits changing road conditions provides for variable speed limits at respective portions of a road based on weather conditions reported by sensor. A plurality of variable speed limit indicators are arranged at predetermined intervals along a road. Sensing report local road conditions regarding humidity, precipitation, temperature, fog, ice, snow, hail, sleet, wind, etc. A regulating unit correlates the sensed weather conditions with a predetermined speed limit for each given condition at each respective portion of the road. A matrix of a database may contain historical accident information regarding the specific location or zone of any accidents, time of day, date, temperature, precipitation, estimated speed and severity of injuries for each accident. The historical data can be correlated with the sensing of weather conditions to adjust the speed limit to a somewhat lower than otherwise value based on the historical data of a respective location. Thus, roads having previously known dangerous portions will have slower speed limits in the rain or snow than other portions reporting the same conditions. Portions of the road can be identified as a bridge, which tends to freeze before the rest of the road, and the variable speed limit reduced to reflect the additional potential hazard.

22 Claims, 2 Drawing Sheets

| ID | ROAD TYPE | CURRENT TEMP | PRECIP. | NUMBER PREVIOUS ACCIDENTS | SEVERITY | SPEED LIMIT |
|---|---|---|---|---|---|---|
| 1 | FLAT | 58°F | DRY | 1 | 4 | 65 MPH |
| 2 | CURVED | 58°F | DRY | 6 | 2 | 60 MPH |
| 2 | CURVED | 58°F | RAIN | 6 | 2 | 50 MPH |
| 3 | BRIDGE | 45°F | RAIN | 7 | 1 | 45 MPH |

AUTOMATIC SETTING OF VARIABLE SPEED LIMIT

BACKGROUND OF THE INVENTION

1. Field of the Invention

The present invention relates to highway safety systems. More particularly, the present invention relates to systems which provide variable speed limits.

2. Description of the Related Art

Conventional highways post speed limits by the use of painted metal signs. In general, a typical speed limit for an Interstate Highway is between 55 to 65 miles per hour. The posted speed limits assume ideal conditions and common sense on the part of motorists to slow down as the conditions change. However, inexperienced drivers, and impatient drivers can be seen on all major roadways trying to maintain the posted speed limit even when it would be dangerous to do so, such as during ice storms, snow storms, fog, hurricanes, sleet, etc.

Periodically, the news will report chain reaction highway crashes where dozens of cars and trucks were involved. The primary reason for these accidents is the drivers were not aware of the need to slow down according to changing conditions, or used poor judgment and attempted to drive at or above posted speed limits during bad weather. Sometimes, the results are catastrophic for the drivers, passengers and other motorists.

Some highway systems, such as the New Jersey Turnpike, use electronic speed limit signs at select areas of the highway. During bad weather, a person or persons at a central site of the Turnpike Authority decides to post a lower speed limit within established guidelines. However, this manual intervention is slow, and for instance, if the case of changing weather conditions, such as an unexpected hail storm, can not respond quickly enough or take into account varying conditions on different portions of the highway.

SUMMARY OF THE INVENTION

One aspect of the present invention is a system for providing the automatic setting of a variable speed limit, wherein a plurality of variable speed limit indicators arranged at predetermined intervals along a road will display different speeds according to weather conditions sensed by local sensors.

Such a system of the present invention may comprise:

- a plurality of variable speed limit indicators arranged at predetermined intervals;
- weather sensing means for sensing weather conditions of a road along a plurality of predetermined locations; and
- regulating means for regulating a particular speed limit along each respective location of said plurality of predetermined locations, said regulating means communicating with said weather sensing means to correlate an output of said weather sensing means at said each respective location with a database comprising a matrix of speed limits according to the output of said weather sensing means for said each respective location;
- wherein said regulating means automatically transmits a respective speed limit for display by a respective speed limit indicator of said plurality of variable speed limit indicators based on one of periodic and continuous communication of weather conditions from said weather sensing means.

The weather conditions are used to regulate the speed limit for each respective location by correlating with a database of predetermined speeds for each portion of the road according to the conditions sense. Historical accident information for each respective location may be used to adjust the speed limit to a safer level for more dangerous portions of a road.

In another aspect of the invention, a method for providing the automatic setting of a variable speed limit includes correlating received weather conditions with predetermined speed limits according to each possible weather condition for each respective location of the road.

DETAILED DESCRIPTION OF THE INVENTION

Figure 1:
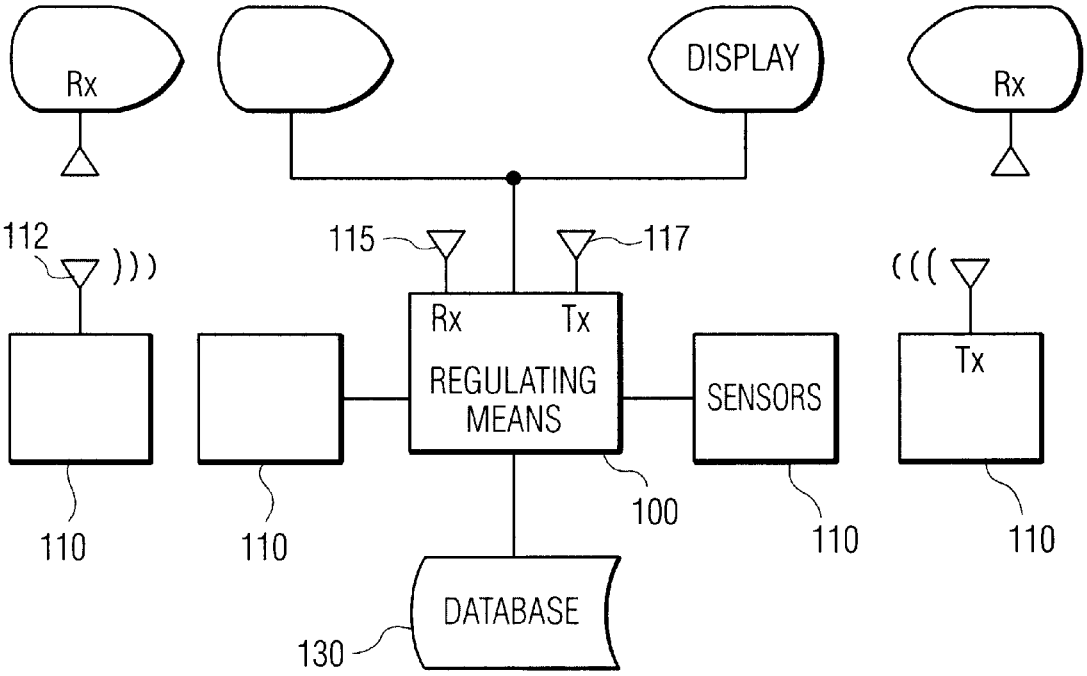
FIG. 1 is an overview of a system according to the present invention.

FIG. 1 is a schematic of a system according to the present invention. A regulating unit 100 communicates with a plurality or sensors 110 arranged in various predetermined locations of a road. The communication can be over hardwire, telephone, radio frequencies, microwaves, fiber optic, or any other known means. The regulating unit 100, based on the reported conditions sensed and compared with predetermined criteria, will output a speed limit to be displayed by displays 120.

The sensors 110 may be capable of monitoring a variety of weather conditions. Alternatively, the sensors can be grouped into a sensing unit, with each sensor monitoring only one item.

It will be appreciated by person of ordinary skill in the art that any known method of weather detection by the sensors could be used, and this system could be adapted to use future sensors not yet known.

For example, it is known that fog can be sensed by transmitting a laser to a reflector, and comparing the difference in the transmitted and received light.

Ice, sleet, and snow, for example, can be detected by optical systems that can be used to detect snow and ice on the wings of aircraft. In those systems, a circularly polarized light beam is aimed at a relatively flat metallic object. A clockwise polarized laser light will reflect off a metal object and return as circularly polarized light in a counter clockwise polarized direction. However, such light will scatter when ice, sleet or snow has accumulated on the object.

For example, any known method for detecting humidity by sensors, including units that monitor change in barometric pressure, and any known method for sensing temperature could be used. In addition, the magnitude and direction of the wind can be monitored. In areas where there are crosswinds, such as bridges or overpasses, the sensed magnitude and direction of the wind can be important information in determining an appropriate speed limit.

The sensors may be linked to the regulating unit by electrical wires, fiber optics, wireless communications (such as RF). In the case of wireless communication, the sensors 110 may be in communication with, or may include, transmission means 112, shown as a schematic for an antenna. The regulating unit 100 can have transmission and receiving capability that could be sharing some common equipment, such as the antenna, or could have separate transmit and receive portions, as shown in by the RX 115 and TX 117. It should also be understood by persons of ordinary skill that there can be a plurality of connection types, where some sensors are connected by fiber optic link, for example, and others are wireless or wire connected. It is even possibly to build in redundancy by having more than one connection type for the same sensor. It should be noted that other redundancies could be included in the system, for example, such as three sensors giving readings for a particular weather condition at a particular location, so that the highest and lowest and disgarded, or their readings are averaged.

The displays 120 can communicate with the regulating means 100 via electrical wire, fiber optic link, wireless communication, even via a network program. The types of communication that the displays have with the regulating means can be intermixed. For example, some displays can use wireless while others can use a fiber optic link.

The displays 120, and/or the regulating means, can be in communication with a weather forecasting service. An alert received from the weather forecasting service may override the speed limit that would be otherwise selected based on the feedback of the sensors and/or historical road conditions. For example, if there are reports of a flash flood or fog some distance away, there can be a desire to start slowing the motorists in anticipation of the hazardous conditions. The degree of the alert may be determinative as to whether the normal sensor readings are overridden.

In lieu of weather alerts, reported traffic alerts, such as stopped vehicles, accidents, etc., can be another reason to begin slowing down the traffic prior to encountering the actual problem. In each case, the displays can be individually controlled with reaction to the sensed or warned condition in real time.

The regulating unit 100, which receives the feedback from the sensors, or the alert from the weather service, may communicate with a database 130. The database can have tables of predetermined speed limits based on the feedback of a sensor or sensors at any given location. The predetermined limits may be based on interpolations of previous accident data for similar roads and recommendations from traffic experts. Alternatively, the database may also have accident report data for the particular area of the road in question logged by condition, day, date, time, severity of accident, severity of weather conditions, type of the particular structure of the road, etc.

For example, if historical conditions indicate that there were two fatal accidents on a particular stretch of road certain criteria match, such as day, date, time, weather conditions, the speed limit may be reduced by 10 miles per hour. If there were only relatively minor incidents and there was a long period of time between, the speed limit may not be reduced. As previously discussed, these criteria are predetermined, and may be adjusted accordingly.

Thus, according to the present invention, even identically sensed conditions by sensors at different locations of the same road can result in different displayed speed limits along the different locations of the same road. One reason for this difference could be the past history of accidents at one area of the road, in general, at a specific time, specific date, or specific condition (many accidents occur at area A during rain then area B). Another factor for this difference could be that one portion of the road is straight, while another is curved. The merging of an entrance ramp at one location could result in different posted speed limits even though sensor readings are approximately the same. Additionally, one portion of the road could be, for example, a bridge, which tends to freeze faster than other parts of the road. Thus, the speed limit crossing the bridge could be slower as a result. Also, if the road surface of the bridge is metallic, there is an increased likelihood of slippage when wet, and thus a lower speed limit may be displayed as a result. The result of varying the speed limit would also have to be factored into safety considerations, because if there are too many variations in the speed limit over a short distance, the likelihood of an accident may actually increase, particularly if a motorist is inattentive to the reduced speed that is displayed.

The database 130 can be part of the regulating unit, or it can be remotely located. It may be accessed over a link, such as a fiber optic link, or accessed over a network. While a closed link might be safer to interruption from others, a more open means of communication could be used. The ability to obtain fast results so that the input of the sensors results in a fast turnaround time to display the speed limit may have a direct impact on the safety of motorists on a particular road. The database can be updated periodically with historical information regarding accident reports. The identification of the specific location of the accident can be entered in a police report, by, for example, road sign markers. Furthermore, if the time and roadside markers are accurate, the question on many standard accident reports regarding the weather conditions can be accurately monitored and stored by the sensors in a storage area of the database.

The sensors 110 may monitor the conditions constantly, or over periods of time, ranging from seconds, to even minutes, hours, etc. The speed limit may only change when the conditions match certain criteria in the database, or if the amount of change in readouts is extensive enough to reduce/increase the speed limit at any particular display. As previously mentioned, the displayed speed of adjacent locations may also be factored into the speed limit for a given location.

Again, the above expressed possible ways of detecting fog snow, ice, sleet, rain, humidity, wind, and temperature are merely illustrations of one of a plurality of ways that the sensors may function, and these examples are not limitations of the sensors that can be used, or the weather conditions that can be monitored.

Figure 2:
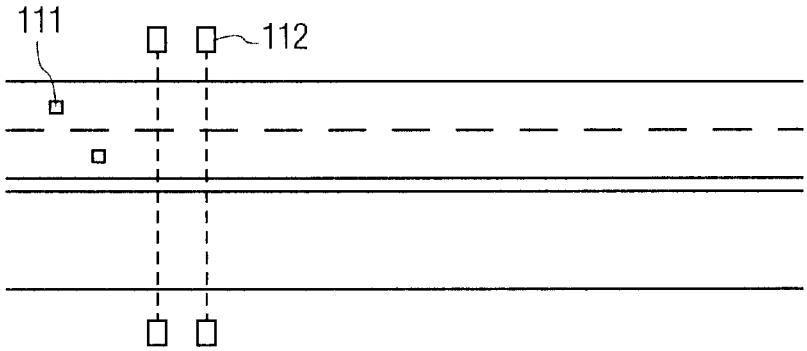
FIG. 2 illustrates some examples of how sensors may be arranged in a roadway.

FIG. 2 illustrates two examples of the many ways that the sensors may be arranged. Sensors in the road 111 are embedded in the road itself, and may sense pressure, water, light, etc.

Sensors 112 check visibility across the road, and one end could be a mirror that reflects an optical signal. The sensors may be diagonally arranged and the general direction to check visibility would be best if it was in the direction of traffic, but it may pose difficulties to arrange such optical sensors in the road.

Figures 3, 4:
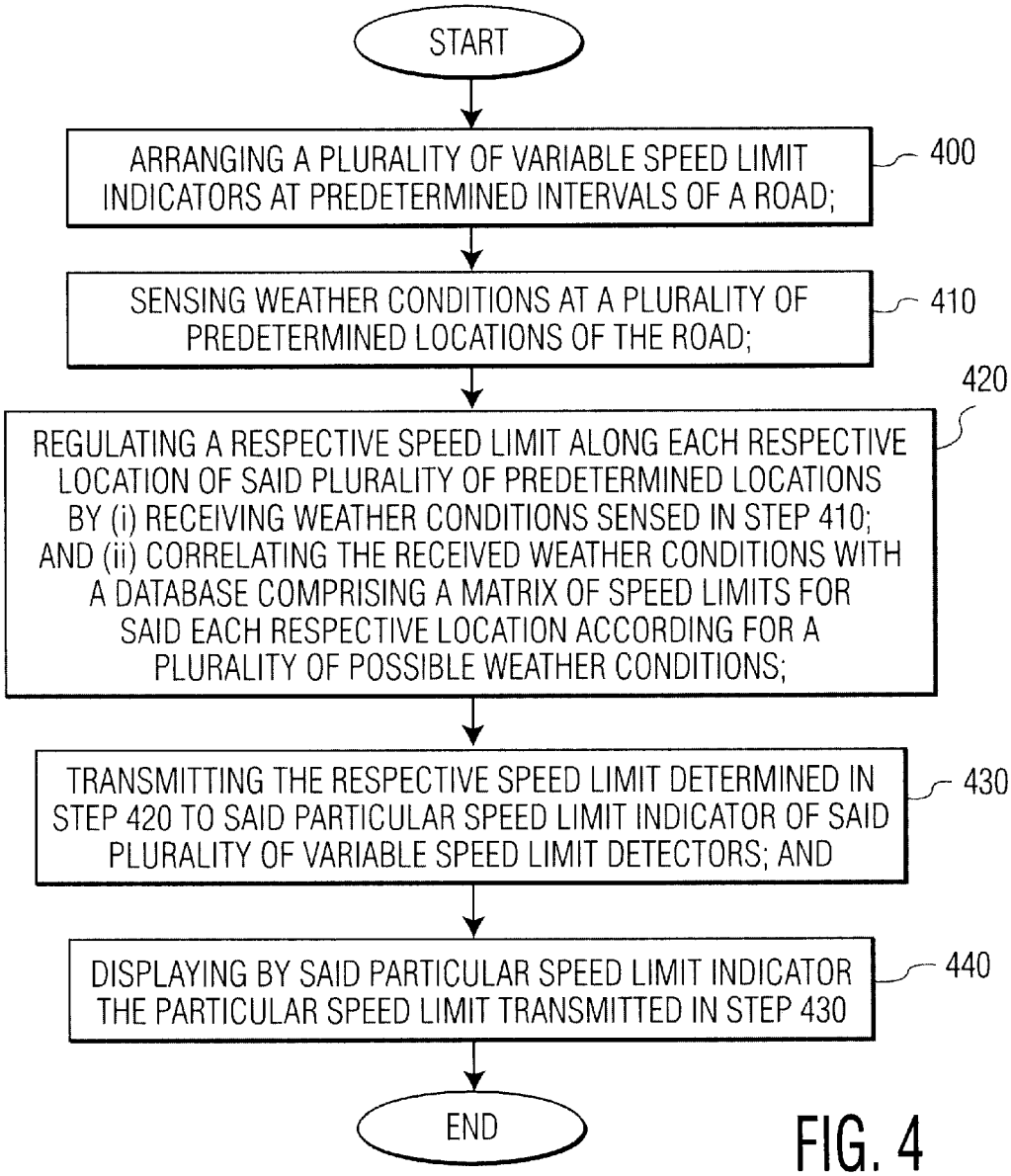
FIG. 3 illustrates a matrix that can be used to regulate a speed limit according to the factors listed in each column.
FIG. 4 provides an overview of a flowchart of the present invention.

FIG. 3 illustrates one way that the table might look regarding sensor readings and historical data, and projected speed limits based on same. In the portion of the road having an identification marker of 1, the sensed temperature is 58 degrees, the road type is known to be flat, there is no precipitation, there has previous been one accident on that stretch of the road with a severity of 4. The severity levels are entirely set according to desire, and in this example, a 1 would be the most sever accident with multiple fatalities, a 2 would be one fatality, and 3 would be serious physical injury, a 4 would be minor physical injuries, and a 5 would be only body damage to the vehicles. The number of classifications, and the identifiers can be set according to need.

In FIG. 3, it can be seen that there have been 6 accidents with one fatality for id. 2 over a predetermined period of time. The combination of injuries, and the curvature in the road, has the regulating means reducing the speed limit to 60 miles per hour instead of the 65 miles per hour for the first id. FIG. 3 also shows id 2 a second time when it is raining. The same stretch of road now has 50 miles per hour limit. Id 3 represents a bridge that has had 7 accidents with multiple fatalities. Accordingly, the speed limit across the bridge is reduced to 45 miles per hour.

The regulating means could incorporate heuristic learning, wherein after a predetermined amount of time without an accident, the regulating means could raise the speed limit within a certain limit, or further reduce it, depending on the lack or number of accidents on any given stretch of the roadway.

FIG. 4 is a flowchart providing an overview of a method of the present invention.

At step 400, a plurality of variable speed limit indicators are arranged at predetermined intervals along a road.

At step 410, weather conditions are sensed by a plurality of sensors at a plurality of predetermined locations. These sensors, as previously explained, could measure temperature, pressure, precipitation, humidity, visibility, fog, ice, sleet, snow, hail, etc. The sensors may be placed, for example, in or on top of the road, or along side the road. The sensors could be placed on posts that raise them a predetermined distance off the ground. The conditions sensed by the sensors are reported back to a regulating unit.

At step 420, the speed limit along the predetermined locations is regulated according to the output of the sensors. This regulating can be, for example, by correlating the sensed weather conditions with a database of predetermined speed limits for a variety of conditions. Historical data regarding the condition of the road and previous accidents may be used as factors.

At step 430, the speed limit regulated in step 420 is transmitted to a specific speed limit indicator of the plurality of indicators.

At step 440, the indicator will display the speed limit transmitted in step 430.

With regard to step 420, an alert code from a weather service can override the correlation of the data and a speed limit may be chosen solely because of the type of code and severity of the weather alert. Alternatively, the alert code could be a factor in the determination of the speed, but not all determinative.

Various modifications may be made by person of ordinary skill in the art, which is within the spirit of the invention and the scope of the appended claims. For example, the type of weather conditions sensed, the placement of the sensors, and the particular criteria used to increase or reduce posted speed limits can be modified.

What is claimed is:

1. An apparatus for automatic setting of a variable speed limit comprising:

weather sensing means for sensing weather conditions of a road along a plurality of predetermined locations; and regulating means for regulating a particular speed limit along each respective location of said plurality of predetermined locations, said regulating means communicating with said weather sensing means to correlate an output of said weather sensing means at said each respective location with a database comprising a matrix of speed limits according to the output of said weather sensing means for said each respective location;

transmitting means for automatically transmitting a respective speed limit for display based on one of periodic and continuous communication of weather conditions from said weather sensing means, wherein said regulating means regulates a speed limit according to historical accident data for said each respective location and weather conditions during each accident in the historical accident data.

2. A system for automatic setting of a variable speed limit, said system comprising:

a plurality of variable speed limit indicators arranged at predetermined intervals;

weather sensing means for sensing weather conditions of a road along a plurality of predetermined locations; and regulating means for regulating a particular speed limit along each respective location of said plurality of predetermined locations, said regulating means communicating with said weather sensing means to correlate an output of said weather sensing means at said each respective location with a database comprising a matrix of speed limits according to the output of said weather sensing means for said each respective location; and transmitting means in communication with said regulating means and said variable speed limit indicators for automatically transmitting a respective speed limit for display by a respective speed limit indicator of said plurality of variable speed limit indicators based on one of periodic and continuous communication of weather conditions from said weather sensing means, wherein said regulating means regulates a speed limit according to historical accident data for said each respective location and weather conditions during each accident in the historical accident data.

3. The system according to claim 2, the respective speed limit transmitted to said respective speed limit indicator is independent of a speed limit of a remainder of said plurality of variable speed limit indicators.

4. The system according to claim 2, wherein said plurality of variable speed limit indicators are categorized into groups based on one of geographic location, direction of traffic flow and volume of traffic.

5. The system according to claim 2, wherein said matrix of speed limits further comprises a historical accident report information identifying a number of accidents at each respective location of said plurality of locations, for each accident of said number of accidents, said historical accident report information includes at least one of: a time of day and date of said each accident, a severity of injuries sustained, and an estimated speed of a vehicle or vehicles in said each accident, so that said regulating means includes said historical accident report information when regulating the speed limit for said each respective location.

6. The system according to claim 2, wherein said weather sensing means includes means for sensing humidity.

7. The system according to claim 2, wherein said weather sensing means includes means for sensing fog.

8. The system according to claim 2, wherein said weather sensing means includes means for sensing at least one of a magnitude and a direction of a wind.

9. The system according to claim 2, wherein said weather sensing means includes means for sensing temperature.

10. The system according to claim 2, wherein said weather sensing means includes means for sensing at least one of ice, sleet, snow and hail.

11. The system according to claim 2, wherein said weather sensing means includes means for sensing an amount of precipitation on the road for at least one of said predetermined respective locations.

12. The system according to claim 2, wherein said transmitting means also includes receiving means for communication with a weather forecasting service, said receiving means communicating an alert received from the weather forecasting service to said regulating means, and said regulating means overriding the matrix in the database for said each respective location with a second matrix according to a type of alert received by the weather forecasting service.

13. The system according to claim 2, wherein said sensing means communicate with said regulating means over a radio frequency.

14. The system according to claim 2, wherein said sensing means communicates with said regulating means over a fiber optic link.

15. A method for providing a variable speed limit comprising the steps of:

(a) arranging a plurality of variable speed limit indicators at predetermined intervals of a road;

(b) sensing weather conditions at a plurality of predetermined locations of the road;

(c) regulating a respective speed limit along each respective location of said plurality of predetermined locations by (i) receiving weather conditions sensed in step (a);

(ii) correlating the received weather conditions with a database comprising a matrix of speed limits for said each respective location according for a plurality of possible weather conditions;

(d) transmitting the respective speed limit regulated in step (c) to said particular speed limit indicator of said plurality of variable speed limit detectors; and (e) displaying by said particular speed limit indicator the particular speed limit transmitted in step (d), wherein the correlating recited in step (c) (ii) includes Providing said database with a historical accident report information identifying a number of accidents at said each respective location of said plurality of locations, and for each accident of said number of accidents, said historical accident report information including at least one of: a time of day and date of said each accident, a severity of injuries sustained, and an estimated speed of a vehicle or vehicles in said each accident, so that said regulating means includes said historical accident report information when regulating the speed limit for said each respective location.

16. The method according to claim 15, wherein step (c) includes (iii) providing for a receipt of a weather alert code by a weather forecasting service; (iv) providing priority to the received weather alert code over the received weather conditions in step (c) (i) and correlated in step (c) (ii); and (v) providing the speed limit for said each respective location based on a predetermined value associated with the weather alert code.

17. The method according to claim 15, wherein the sensing of weather conditions in step (b) includes sensing humidity.

18. The method according to claim 15, wherein the sensing of weather conditions in step (b) includes sensing fog.

19. The method according to claim 15, wherein the sensing of weather conditions in step (b) includes sensing temperature.

20. The method according to claim 15, wherein the sensing of weather conditions in step (b) includes sensing at least one of a magnitude and a direction of wind.

21. The method according to claim 15, wherein the sensing of weather conditions includes sensing for one of ice, sleet, snow and hail.

22. The method according to claim 15, wherein the weather conditions sensed in step (b) are received in step (c) (i) over one of a fiber optic link and radio frequency transmission.

* * * * *